United States Patent [19]

Feyerl et al.

[11] Patent Number: 4,536,927

[45] Date of Patent: Aug. 27, 1985

[54] APPARATUS FOR MANUFACTURING ENDLESS NEEDLED PAPER MACHINE FELTS

[75] Inventors: Günther Feyerl; Klaus Minichshofer, both of Linz; Hans G. Pum, Wels, all of Austria

[73] Assignee: Textilmaschinenfabrik Dr. Ernst Fehrer Aktiengesellschaft, Leonding, Austria

[21] Appl. No.: 547,399

[22] Filed: Oct. 31, 1983

[30] Foreign Application Priority Data

Dec. 10, 1982 [AT] Austria ..... 4494/82

[51] Int. Cl.[3] ..... D04H 18/00

[52] U.S. Cl. ..... 28/110; 28/111; 28/115

[58] Field of Search ..... 28/110, 111, 113, 114, 28/107

[56] References Cited

FOREIGN PATENT DOCUMENTS 1660765 8/1971 Fed. Rep. of Germany .
2324985 7/1980 Fed. Rep. of Germany .

*Primary Examiner*—Robert R. Mackey
*Assistant Examiner*—Joseph S. Machuga
*Attorney, Agent, or Firm*—Kurt Kelman

[57] ABSTRACT

Apparatus for manufacturing endless needled paper machine felts comprising at least one ply formed by a plurality of overlapping loops of a sliver web comprises a needling machine having a working width corresponding to the width of the paper machine felt, and a sliver web feeder which is adapted to be reciprocated throughtout the working width of the needling machine. To ensure that the needling can be properly effected without a formation of wrinkles, a needling device having a working width corresponding to that of the feeder is provided between the feeder and the needling machine and is adapted to be reciprocated in unison with the feeder throughout the working width of the needling machine.

3 Claims, 2 Drawing Figures

APPARATUS FOR MANUFACTURING ENDLESS NEEDLED PAPER MACHINE FELTS

BACKGROUND OF THE INVENTION

This invention relates to apparatus for manufacturing endless needled paper machine felts comprising at least one ply formed by a plurality of overlapping loops of a silver web, comprising a needling machine having a working width corresponding to the width of the paper machine felts to be manufactured and a sliver web feeder which is adapted to be reciprocated throughout the working width of the needling machine.

In the usual manufacture of paper machine felts, a sliver web is reciprocated throughout the width of an endless backing woven fabric and is applied to the latter and is subsequently needled to the backing woven fabric. Because a transverse orientation of the fibers with respect to the direction of travel of the paper machine felt is not desired, it has been disclosed in Laid-open German Application No. 1,660,765 that a more appropriate, longitudinal orientation of the sliver fibers in the longitudinal direction of the sliver web can be achieved in that the sliver webs are trained around two feed rollers so as to form loops, which after the needling operation are axially pulled from the feed rollers so that a tubing is formed, which consists of a ply formed by a plurality of overlapping loops of a sliver web. That known manufacture of paper machine felts has the disadvantage that feed rollers provided with axially aligned conveyor chains are required because the web loops trained around the two feed rollers are pulled off axially, so the structural expenditure is high. Besides, as the felt is pulled off axially, only a single ply of overlapping web loops can be formed so that the fibers have a preferential orientation at an acute angle to the direction of travel of the endless paper machine felt and there is a risk of a distortion by which the running properties of the felt are adversely affected and a formation of wrinkles is promoted.

From German Patent Publication No. 2,324,985 it is known that these disadvantages can be avoided in that a sliver web is supplied to an endless backing woven fabric in its longitudinal direction by means of a feeder which is adapted to be reciprocated throughout the width of the backing woven fabric. In that practice, two or more plies formed by overlapping loops of a sliver web can be applied to the backing woven fabric so that the loops of adjacent plies cross each other. The crossing fiber orientations of these plies ensure that any asymmetry of one ply with respect to the direction of travel of the felt will be compensated so that the running properties and the strength values will be considerably improved, particularly because the loops of the sliver web are needled to a backing woven fabric and the needling machine used for that purpose has a working width corresponding to the width of the paper machine felt to be manufactured. On the other hand, that manufacture of paper machine felts has the disadvantage that sufficiently strong joints between the several loops of the sliver web and between the sliver plies and the backing woven fabric cannot be achieved before the plies of sliver web are needled to the backing woven fabric. This is so because the sliver web which has been applied to the backing woven fabric in loops by means of the feeder is merely forced by means of a pressure roller against the backing woven fabric or against a sliver ply which has been formed before. The adhesion which can be achieved by such contact pressure may permit the sliver web to lift at least locally from its support so that wrinkles may form during the needling operation. The inadequate strength of the joints between the backing woven fabric and the sliver plies promotes also the fixation of wrinkles by the needling operation and the formation of thicker and thinner portions because the sliver plies and the backing woven fabric differ in stretch behavior as portions of the sliver plies can shift relative to the backing woven fabric. For this reason, paper machine felts manufactured by that process have not been successful in practice.

OBJECT AND SUMMARY OF THE INVENTION

It is an object of the invention to avoid these disadvantages and so to improve apparatus of the kind described first hereinbefore that the loops of sliver web can be connected to each other and to the backing woven fabric in such a manner before the needling of the applied sliver plies that a satisfactory needling without a risk of a formation of wrinkles or of thicker or thinner portions will be ensured.

This object is accomplished in accordance with the invention in that a needling device which is adapted to be reciprocated in unison with the feeder throughout the working width of the needling machine and has a working width corresponding to the working width of the feeder is provided between the feeder and the needling machine.

By means of the additional needling device provided between the needling machine and the feeder, the sliver web which is being fed to the backing woven fabric can be tacked in a simple manner to the backing woven fabric so that the desired joint between the sliver web and the backing woven fabric is achieved. In this manner, all undesired results which may be due to a lifting of the several sliver plies from each other and from the backing woven fabric or to a shifting of individual sliver plies will be avoided. The joint formed by the needling of the sliver web as it is applied to the backing woven fabric need not be strong because it is sufficient to tack the sliver plies to each other and to the backing woven fabric. Because the working width of the additional needling device corresponds to the working width of the feeder and the additional needling device performs a traversing motion in unison with the feeder, a uniform needling throughout the working width of the needling machine will be ensured although the several sliver plies are formed at that time.

In the use of the apparatus according to the invention there will be no need for a backing woven fabric if the sliver web conveyed by the feeder is first needled to form an endless tubing by means of the needling device provided between the needling machine and the feeder and nonwoven fabrics having a transverse fiber orientation with respect to the fibers of the tubing are needled to that tubing throughout its width in conventional manner by means of the needling machine. The resulting felt comprises transversely and longitudinally oriented fibers, which ensure the desired strength values.

A similar result can be produced in that the sliver web supplied to the needling device comprises a random fiber layer and the tubing made from such sliver web by means of the needling device is subsequently needled throughout its width by means of the succeeding needling machine so as to form the felt.

Because the needling device serves substantially only to join the sliver web to a backing woven fabric or to tack the overlapping loops of the sliver web to each other whereas the actual needling to form the felt is effected in the succeeding needling machine, the needle density and the depth of needle penetration may be smaller in the needling device than in the needling machine.

BRIEF DESCRIPTION OF THE DRAWINGS

An illustrative embodiment of the invention is shown on the accompanying drawing, in which.

DETAILED DESCRIPTION OF THE INVENTION

Figure 1:
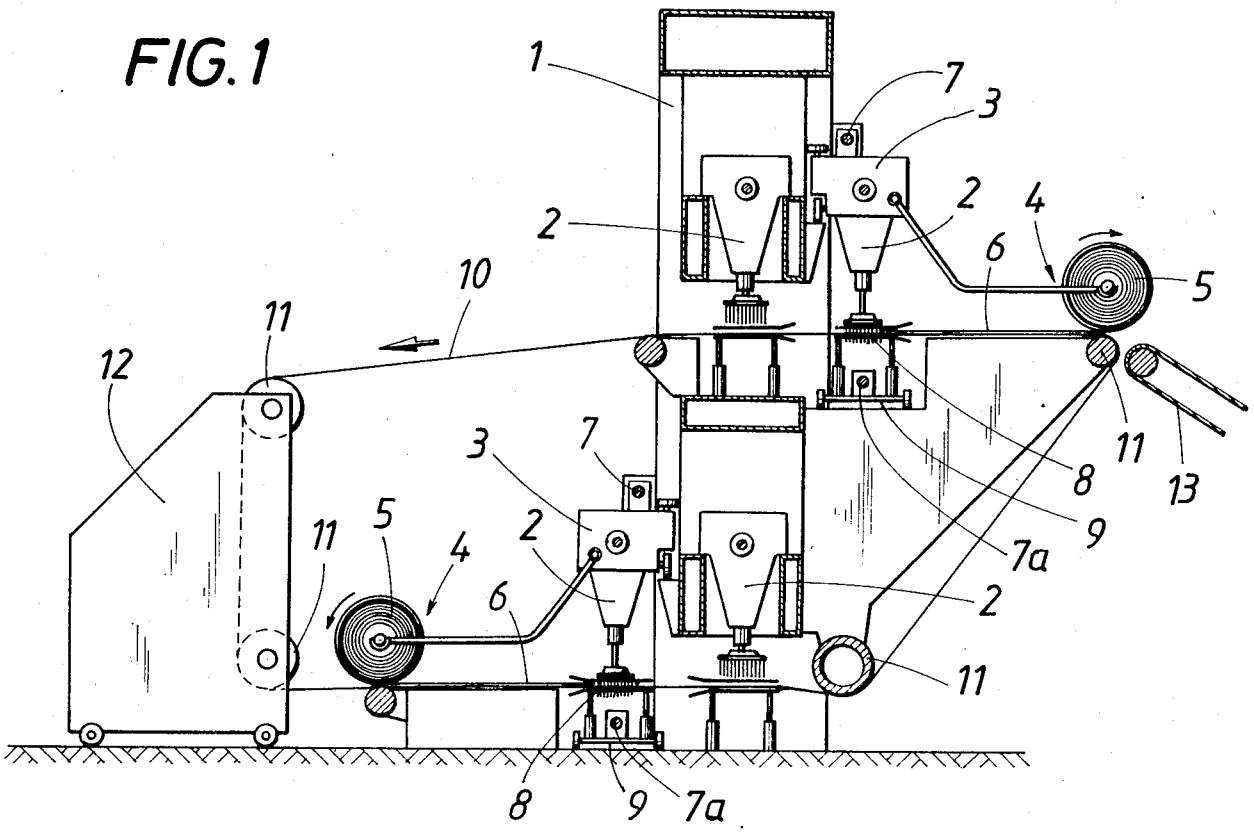
FIG. 1 is a diagrammatic side elevation showing apparatus according to the invention for manufacturing endless paper machine felts and FIG. 2 is a top plan view showing that apparatus on a reduced scale.
Figure 2:
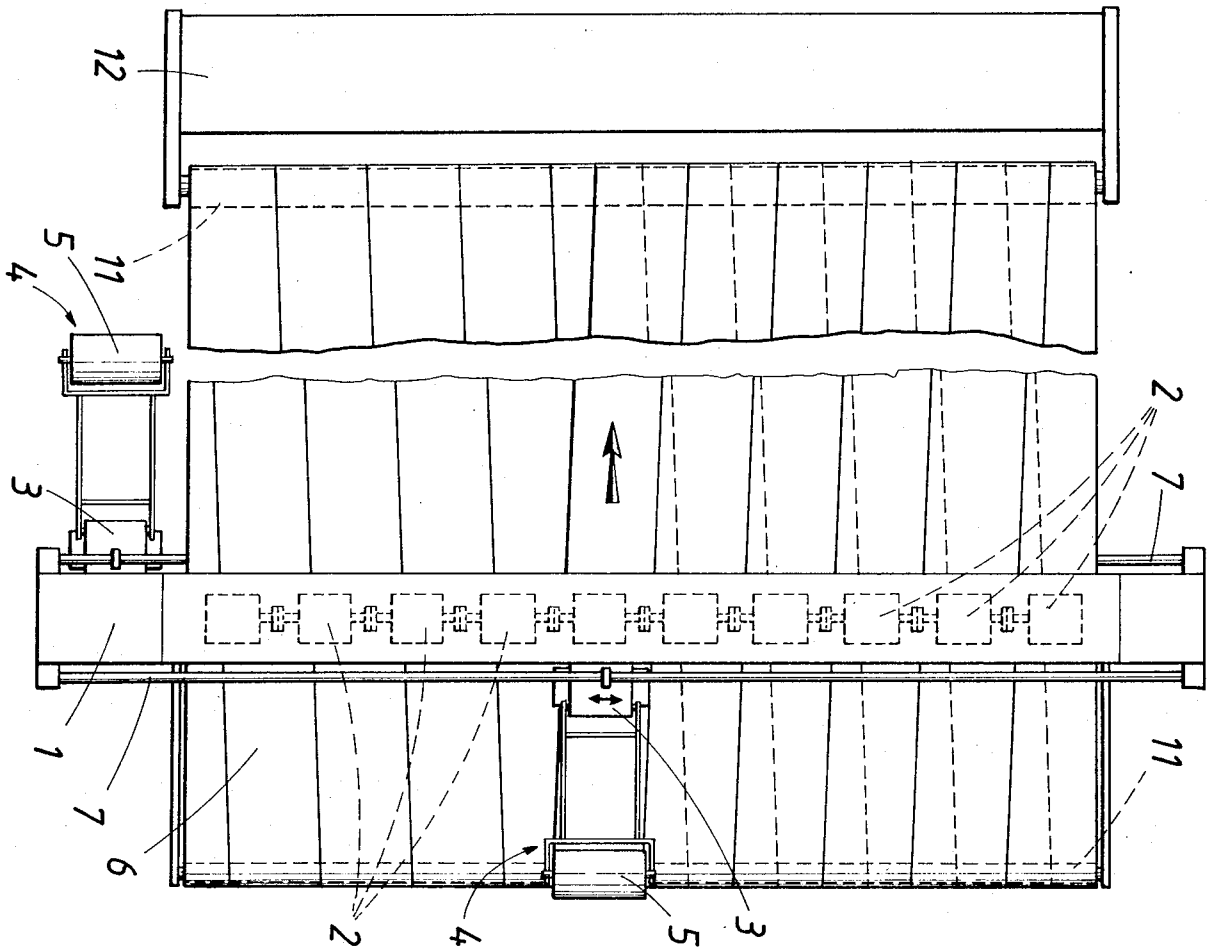

As is apparent from FIGS. 1 and 2, the illustrated apparatus substantially comprises a modular needling machine 1, which is assembled from a plurality of needling units 2 so that the needling machine 1 has a working width corresponding to the width of the paper machine felts to be manufactured. The needling machine 1 is preceded by a needling device 3, which comprises only one needling unit 2 so that it has a correspondingly smaller working width. The needling device 3 is connected to a preceding sliver web feeder 4, which in the embodiment shown by way of example consists of a supply roll 5 of sliver web 6. That supply roll 5 is pivoted to the needling device 3. It will be understood that such supply roll might be replaced by a card for forming a sliver web. In any case, the feeder 4 must be adapted to be reciprocated in unison with the needling device 3 throughout the working width of the needling machine 1. For this purpose the needling device 3 comprises a carriage, which is guided on the needling machine 1 and is adapted to be reciprocated by means of a feed screw 7. Whereas the mounting of the feeder 4 on the needling device 3 is not essential, such mounting will eliminate the need for separate means for guiding and driving the feeder 4. As the needling device 3 must be reciprocated in unison with its vertically adjustable table top 8, the underframe 9 of the needling device 3 is also slidably mounted on the needling machine 1 and by means of a feed screw 7*a* is adapted to be driven in synchronism with the upper frame of the needling device.

The sliver web 6 which has been withdrawn from the supply roll 5 can be joined by the needling device 3 to an endless backing woven fabric 10, which is trained around deflecting rollers 11. One pair of said deflecting rollers 11 are mounted in a tensioning carriage 12. Because the supply roll 5 moves transversely to the backing woven fabric 10 together with the needling device 3 as the sliver web 6 is supplied from the supply roll 5, the sliver web 6 tacked to the backing woven fabric 10 by the needling device 3 will extend at a bias angle, which will depend on the speed of travel of the backing woven fabric and on the traversing speed of the needling device. As a result, the sliver web 6 is applied in a plurality of overlapping loops which extend at a predetermined bias angle and form a ply, to which another, similar sliver ply can be applied, in which the loops extend at a bias angle which is equal and opposite to that of the underlying ply so that any asymmetry with respect to the longitudinal direction of the backing woven fabric which is due to the bias angle of one ply can be compensated.

Because the needling device 3 can be used to provide between the sliver plies and the backing woven fabric 10 a joint which will prevent a lifting and shifting of the sliver plies, the resulting composite can be needled throughout its width in the needling machine 1 when the sliver plies have been applied to the backing woven fabric and there will be no risk of a formation of wrinkles or thicker or thinner portions.

If a needling device 3 and a sliver web feeder 4 is provided on the inside of the endless web of backing woven fabric, as is indicated in FIG. 1, it will be possible to needle the sliver web 6 also to the inside surface of the backing woven fabric 10 with equally good results.

Because adjoining courses of sliver web can be joined by needling them by means of the needling device 3, the need for a backing woven fabric 10 in the manufacture of paper machine felts can be eliminated because the sliver web 6 can be trained in loops around the deflecting rollers 11 so as to form a tubing and nonwoven fabrics having a fiber orientation which is transverse to that of the tubing fibers can be applied to that tubing throughout its width and can be needled to the tubing in the needling machine 1. The resulting felt comprises longitudinally and transversely oriented fibers so that the desired strength will be ensured. The nonwoven fabrics having a transverse fiber orientation are supplied to the tubing by a conveyor 13.

We claim:

1. In apparatus for manufacturing an endless needled paper machine felt up to a predetermined maximum width, the felt comprising at least one ply formed by a plurality of overlapping loops of a sliver web, which apparatus comprises a needling machine having a working width equal to said predetermined maximum width and a sliver web feeder operable to feed a sliver web to said needling machine, wherein the improvement comprises a needling device of smaller working width than the needling machine between said needling machine and said sliver web feeder, the needling device and the feeder having the same working width, and means for reciprocating the needling device with the feeder in unison throughout the working width.

2. The improvement set forth in claim 1, wherein said needling device has a needle density and a depth of needle penetration which are respectively smaller than the needle density and the depth of needle penetration of said needling machine.

3. The improvement set forth in claim 1, wherein the reciprocating means comprises a common guide and driving device for the needling device and the feeder, the feeder being mounted on the needling device for common movement thereof.

* * * * *